US006843033B2

(12) United States Patent
Okumura

(10) Patent No.: US 6,843,033 B2
(45) Date of Patent: Jan. 18, 2005

(54) CONNECTING MECHANISM FOR CEILING PANEL SUPPORTING STRINGERS

(75) Inventor: Masahiro Okumura, Gifu (JP)

(73) Assignee: Kabushiki Kaisha Okumura Seisakusho, Gi Fu (JP)

( * ) Notice: Subject to any disclaimer, the term of this patent is extended or adjusted under 35 U.S.C. 154(b) by 0 days.

(21) Appl. No.: 10/434,843

(22) Filed: May 9, 2003

(65) Prior Publication Data

US 2004/0159064 A1 Aug. 19, 2004

(30) Foreign Application Priority Data

Feb. 13, 2003 (JP) ..... 2003-034934

(51) Int. Cl.[7] ..... E04B 9/22
(52) U.S. Cl. ..... 52/506.07; 52/733.1; 52/667
(58) Field of Search ..... 52/506.07, 733.1, 52/667

(56) References Cited

U.S. PATENT DOCUMENTS 3,093,221 A * 6/1963 Purdy ..... 403/219
3,193,063 A * 7/1965 Brown et al. ..... 52/667
3,288,489 A * 11/1966 Jahn ..... 403/285
4,462,198 A * 7/1984 Sharp ..... 52/667
4,648,230 A * 3/1987 Mieyal et al. ..... 52/667
5,044,138 A * 9/1991 Zaccardelli et al. ..... 52/667
5,761,868 A * 6/1998 LaLonde et al. ..... 52/506.07
5,966,887 A * 10/1999 Mieyal ..... 52/506.07
6,729,100 B2 * 5/2004 Koski et al. ..... 52/726.2

FOREIGN PATENT DOCUMENTS

JP 2002-285675 10/2002

OTHER PUBLICATIONS

Patent Abstracts of Japan for JP 2002–285675 published on Oct. 3, 2002.

* cited by examiner

*Primary Examiner*—Brian E. Glessner
*Assistant Examiner*—Basil Katcheves
(74) *Attorney, Agent, or Firm*—Darby & Darby

(57) ABSTRACT

A first ceiling panel supporting stringer 1 has an insertion hole 10 formed through a main plate portion 4 thereof, and a second ceiling panel supporting stringer has a base plate portion 21 extending from an end thereof and having a forward end engageable with one side of the main plate portion 4 of the first ceiling panel supporting stringer 1, and a connecting projection 22 extending from the forward end of the base plate portion 21. The connecting projection 22 has a U-shaped rise 24, which is provided with a reinforcing rib 31 for improved strength. The first and second ceiling panel supporting stringers can be unseparably connected by pressingly inserting the connecting projection 22 of the second ceiling panel supporting stringer 1 through the insertion hole 10 of the first ceiling panel supporting stringer 1 without special skills. Also, the U-shaped rise 24 can be formed by swaging without preprocessing such as bending, so that the production process of the ceiling panel supporting stringer 1 can be facilitated, enhancing production efficiency and reducing production costs.

14 Claims, 28 Drawing Sheets

(A)

(B)

(B')

(A)

(B)

(A)

(B)

CONNECTING MECHANISM FOR CEILING PANEL SUPPORTING STRINGERS

BACKGROUND OF THE INVENTION

This invention relates to a connecting mechanism for connecting ceiling panel supporting stringers in a T-configuration.

A ceiling panel supporting stringer is of generally inverted T-shape in cross-section, and has lower horizontal portions as engaging edges for supporting edges of ceiling panels (see FIG. 28) and an upper wide portion as an engaging bulge to which hangers h (see FIG. 28) can be secured.

The ceiling panel supporting stringers are assembled into a lattice and support a multiplicity of ceiling panels p in alignment to form a ceiling of a room.

When the ceiling panel supporting stringers are assembled into a lattice, an end of a ceiling panel supporting stringer may be connected to a side of another ceiling panel supporting stringer to form a T-configuration. Thus, there has been proposed a connecting mechanism for connecting ceiling panel supporting stringers 1 comprising an L-shaped connecting projection extending from an end of a first ceiling panel supporting stringer and having an engaging hole, a fitting hole which is formed through a second ceiling panel supporting stringer and into which the L-shaped connecting projection is press-fittable, and an engaging projection formed on one side of the second ceiling panel supporting stringer and engageable with the engaging hole of the first ceiling panel supporting stringer for preventing disengagement of the L-shaped connecting projection from the fitting hole.

In the conventional connecting mechanism, the first ceiling panel supporting stringer must be struck to insert the L-shaped connecting projection thereof into the fitting hole of the second ceiling panel supporting stringer. At this time, the ceiling panel supporting stringers may be damaged, so that the work of connecting the ceiling panel supporting stringers requires skills and takes time and effort. Also, the L-shaped connecting projection and the fitting hole take time and effort to form and make the configuration of the ceiling panel supporting stringers complicated.

SUMMARY OF THE INVENTION

It is, therefore, an object of the present invention to provide a connecting mechanism for ceiling panel supporting stringers which makes it easy to connect the ceiling panel supporting stringers and which can accomplish enhancement of production efficiency, reduction of production costs and improved strength of the ceiling panel supporting stringers.

The present invention provides a connecting mechanism for connecting first and second ceiling panel supporting stringers in a T configuration, each of the ceiling panel supporting stringers comprising a main plate portion having a lower end and engaging edges extending from the lower end of the plate portion for supporting edges of ceiling panels, the connecting mechanism comprising:

an insertion hole formed through the main plate portion of the first ceiling panel supporting stringer;

a base plate portion extending from an end of the second ceiling panel supporting stringer and having a forward end;

a connecting projection extending in the same direction as the extending direction of the base plate portion from the forward end of the base plate portion and having a vertical length which is generally the same as that of the insertion hole; and a backward projection extending at an angle of about 180 degrees from the connecting projection and having an end edge, the backward projection being shaped such that the distance from the end edge to the forward end of the base plate portion is generally the same as the thickness of the main plate portion of the ceiling panel supporting stringer, whereby, when the connecting projection of the second ceiling panel-supporting stringer is pressingly inserted through the insertion hole of the first ceiling panel supporting stringer, the forward end of the connecting projection of the second ceiling panel supporting stringer abuts against one side of the main plate portion of the first ceiling panel supporting stringer and the end edge of the backward projection of the second ceiling panel abuts against the other side of the main plate portion of the first ceiling panel supporting stringer beside the insertion hole to prevent the connecting projection of second ceiling panel supporting stringer from being withdrawn from the insertion hole of the first ceiling panel supporting stringer.

When the connecting projection extending from one end of the second ceiling panel supporting stringer is pressingly inserted into the insertion hole formed through the main plate portion of the first ceiling panel supporting stringer, the backward projection of the connecting projection is elastically pressed until it becomes parallel to the base plate portion, allowing the insertion of the connecting projection through the insertion hole. Then, when the forward end of the base plate portion of the second ceiling panel supporting stringer abuts against the one side of the main plate portion of the first ceiling panel supporting stringer, the main plate portion of the first ceiling panel supporting stringer is positioned between the forward end of the base plate portion and the end edge of the backward projection of the base plate portion of the second ceiling panel supporting stringer. At this position, the backward projection is released and restored to its original position, and the end edge of the backward projection abuts against the other side of the main plate portion of the first ceiling plate supporting stringer beside the insertion hole. Thereby, the connecting projection of the second ceiling plate supporting stringer is prevented from being withdrawn from the insertion hole of the first ceiling plate supporting stringer, and the first and the second ceiling plate supporting stringer are held in connection with each other.

BRIEF DESCRIPTION OF THE DRAWINGS

Other objects, features and advantages of the present invention will become apparent from the detailed description of the preferred embodiments of the invention which follows, when considered in the light of the accompanying drawings, in which:

FIG. 6(A) illustrates the connecting projection 22 before insertion through the insertion hole 10;

FIG. 6(B) is a cross-sectional view taken along the line A—A in FIG. 1, illustrating the connecting projection 22 after insertion through the insertion hole 10;

FIG. 9(*b*) illustrates another configuration of the reinforcing rib 31 of the U-shaped rise 24 according to the fourth embodiment;

FIG. 9(*c*) illustrates another configuration of the reinforcing rib 31 of the U-shaped rise 24 according to the fourth embodiment;

DETAILED DESCRIPTION OF THE PREFERRED EMBODIMENTS OF THE INVENTION

Description will be hereinafter made of the embodiments of the present invention with reference to accompanying drawings.

Figure 1:
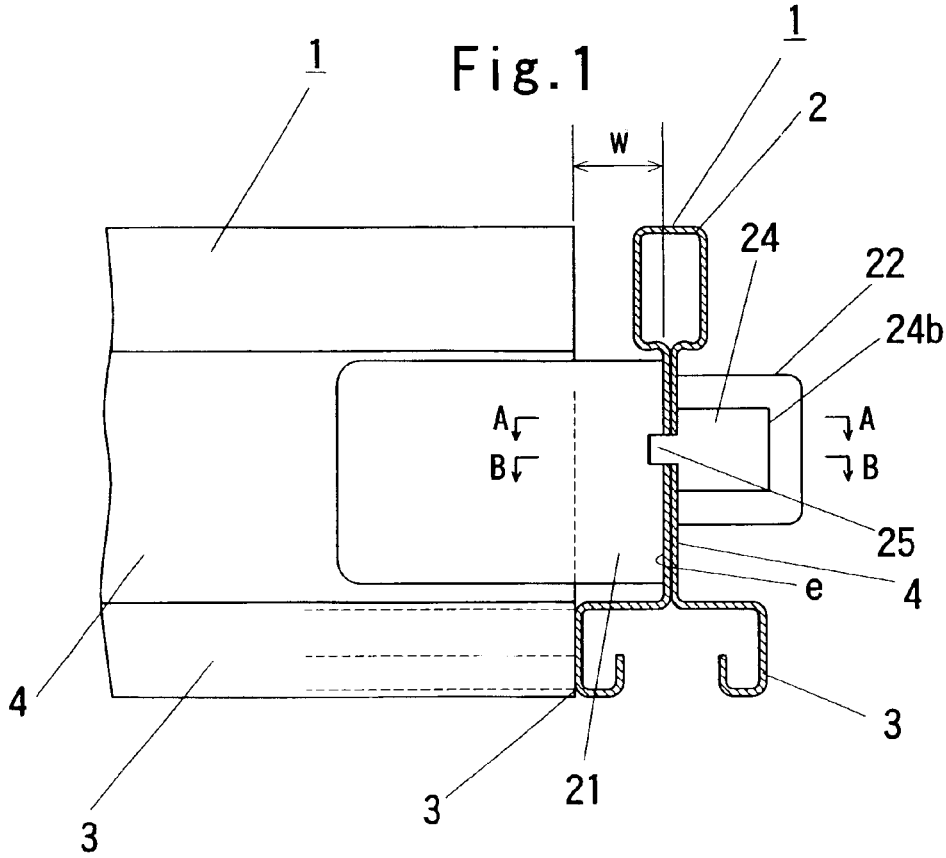
FIG. 1 is a vertical cross-sectional side view illustrating a connecting mechanism for ceiling panel supporting stringers 1 according to a first embodiment.
Figure 28:
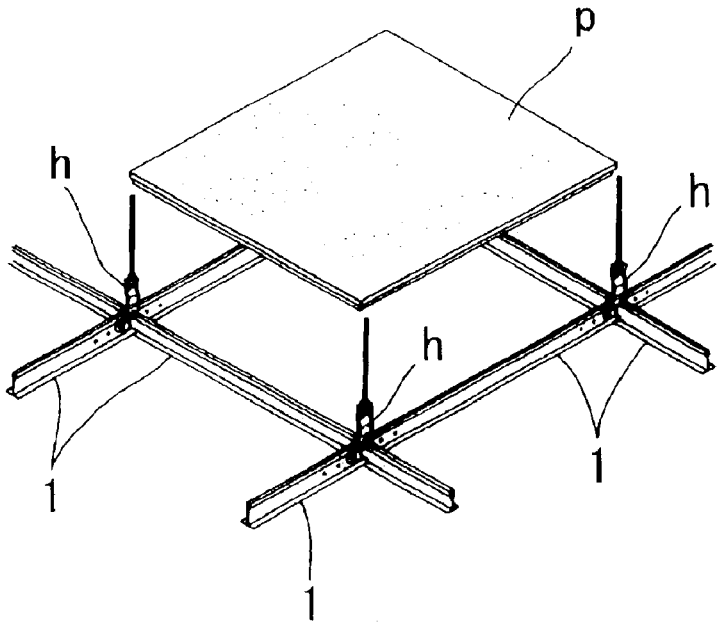
FIG. 28 is a perspective view illustrating a connecting structure of the ceiling panel supporting stringers 1.

FIG. 1 shows ceiling panel supporting stringers 1 connected by means of a connecting mechanism according to the present invention. The ceiling panel supporting stringer 1 is of generally inverted T shape in cross section as shown in FIG. 4, and comprises a main plate portion 4, lower horizontal portions as engaging edges 3 and 3 for supporting edges of ceiling panels p (see FIG. 28), and an upper wide portion as an engaging bulge 2 to which hangers h (see FIG. 28) can be secured.

Figure 2:
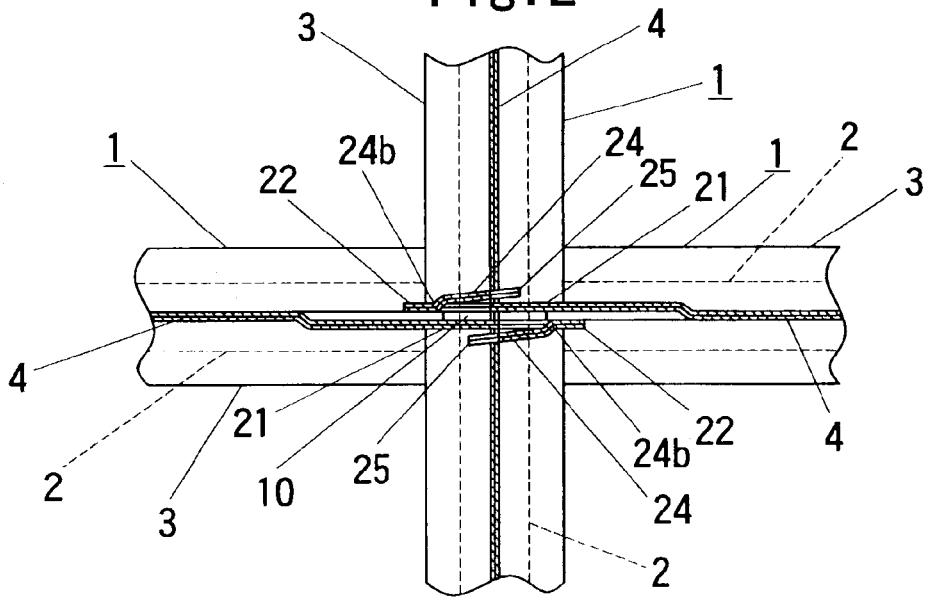
FIG. 2 is a transverse cross-sectional side view illustrating the connecting mechanism for the ceiling panel supporting stringers 1 according to the first embodiment.

As shown in FIG. 1, the ceiling panel supporting stringers 1 and 1 are connected in a T configuration. When two ceiling panel supporting stringers 1 are connected to both sides of another ceiling panel supporting stringer 1, the ceiling supporting stringers 1, 1 and 1 form an X configuration as shown in FIG. 2.

Description will be made of the connecting mechanism for connecting the ceiling supporting stringers 1.

Figure 3:
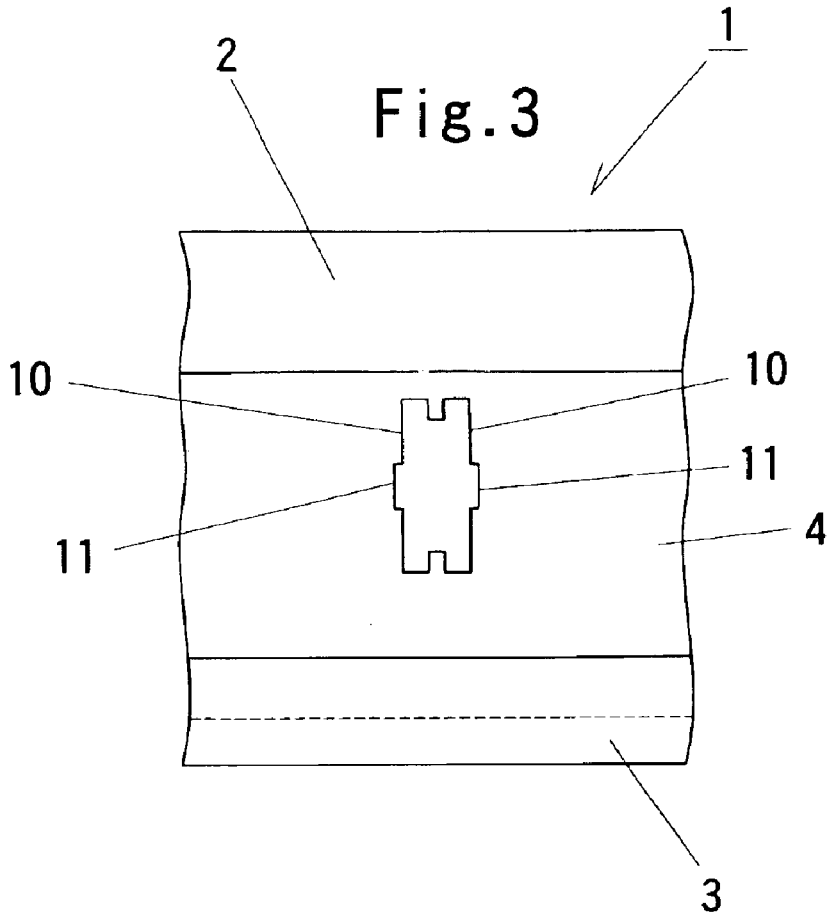
FIG. 3 is a front view illustrating an insertion hole 10 of the ceiling panel supporting stringer 1 according to the first embodiment.
Figure 4:
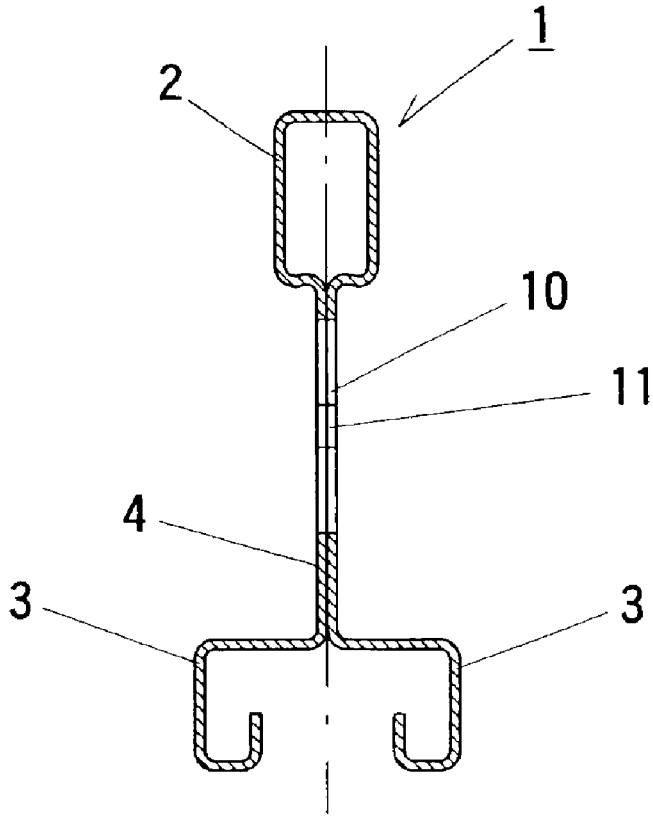
FIG. 4 is a vertical cross-sectional side view illustrating the insertion hole 10 of the ceiling panel supporting stringer 1 according to the first embodiment.

As shown in FIG. 3 and FIG. 4, a first ceiling supporting stringer 1 has vertical rectangular insertion holes 10 and 10 formed adjacent to each other through the main plate portion 4 thereof. The insertion holes 10 and 10 are communicated to each other. Ends of second and third ceiling supporting stringers 1 are inserted through the insertion holes 10 and 10, respectively, from both sides of the main plate portion 4, whereby the ceiling supporting stringers 1 are connected in an X configuration as described above. A restricting notch 11 is formed in the middle of an edge of each of the insertion holes 10 and 10. The restricting notch 11 will be described in detail later.

As shown in FIG. 1, a second ceiling supporting stringer 1 has a base plate portion 21 extending in the longitudinal direction from an end thereof for a length corresponding to the width W of the engaging edge 3. The base plate portion 21 has an end (e) to be in contact with the main plate portion 4 of the first ceiling supporting stringer 1. The base plate portion 21 is slightly bulged in the thickness direction of the ceiling supporting stringer 1 by press working.

Figure 5:
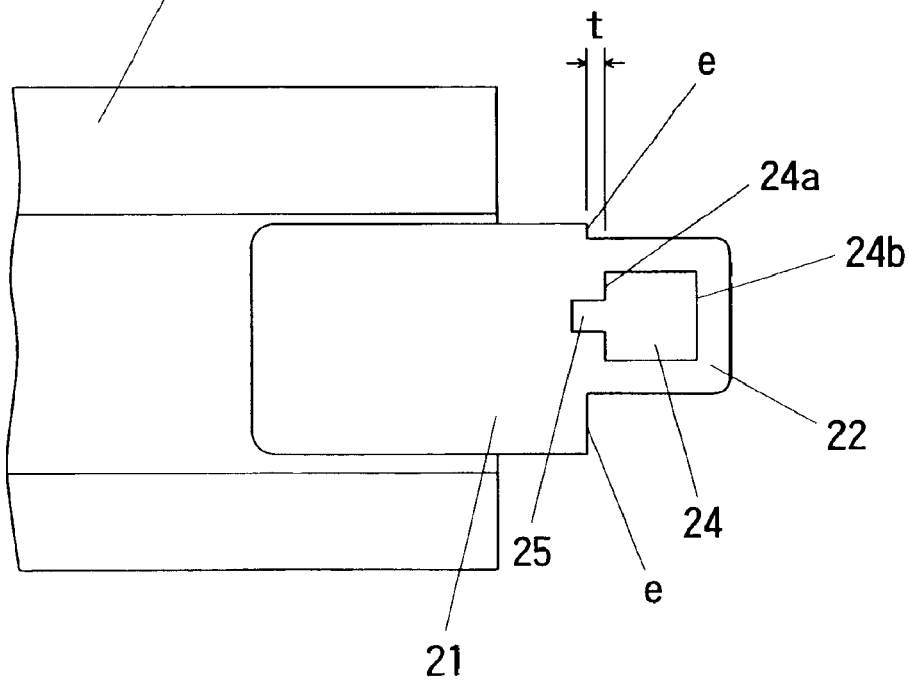
FIG. 5 is a front view illustrating a connecting projection 22 provided to the ceiling panel supporting stringer 1 according to the first embodiment.
Figure 6:
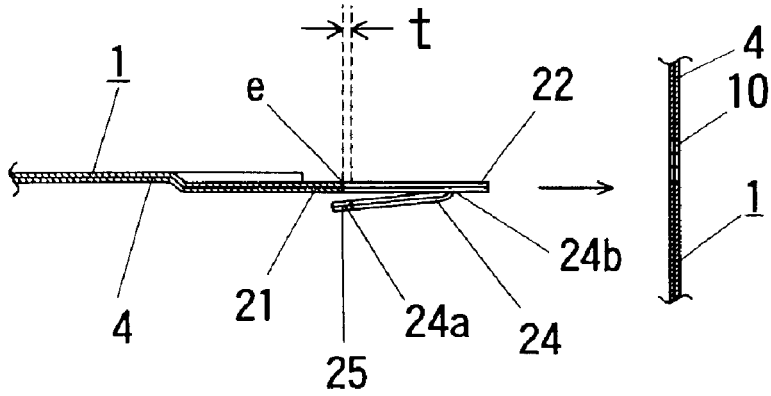
FIG. 6(B') is a cross-sectional view taken along the line B—B in FIG. 1, illustrating the connecting projection 22 after insertion through the insertion hole 10.
Figure 6:
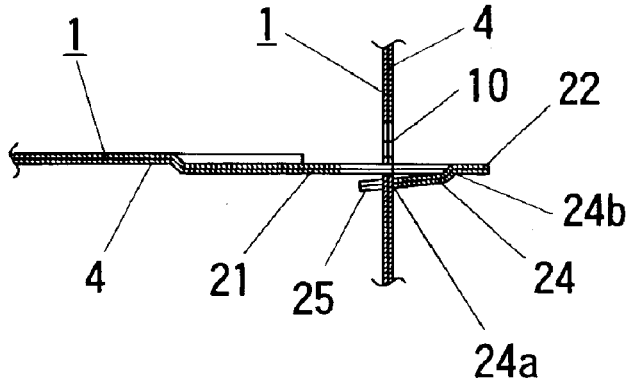
Figure 6:
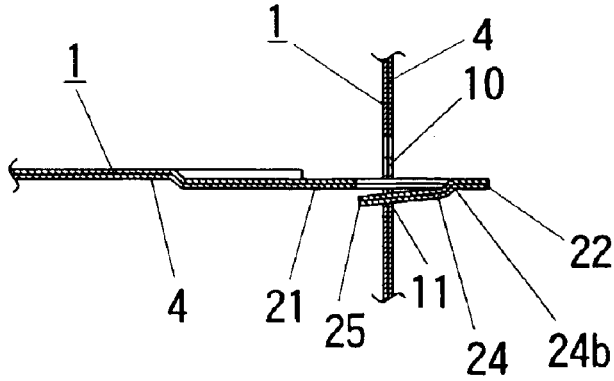

As shown in FIG. 5, a connecting projection 22 protrudes from the end (e) of the base plate portion 21. The vertical length of the connecting projection 22 is almost the same as that of the insertion hole 10. A U-shaped rise 24 is formed at a center portion of the connecting projection 22. The U-shaped rise 24 has a free backward edge 24*a* and a forward edge as a connecting base 24*b* continuous with the connecting projection 22, and is raised from a surface of the connecting projection 22 in a thickness direction thereof by bending the connecting base 24*b* as shown in FIG. 2 and FIG. 6. Thus, the U-shaped rise extends at about 180 degrees to the extending direction of the base plate portion 21. The U-shaped rise 24 is of U-shape as viewed from a side. The distance t from the end (e) of the base plate portion 21 to the free edge 24*a* of the U-shaped rise 24 (see FIG. 5 and FIG. 6(B)) is almost the same as the thickness of the main plate portion 4 of the ceiling panel supporting stringer 1. The raised height of the U-shaped rise 24 from the surface of the connecting projection 22 is slightly larger than the width of the insertion hole 10. The U-shaped rise 24 constitutes a backward projection according to the present invention.

A restricting lug 25 protrudes from an intermediate portion of the free edge 24*a* of the U-shaped rise 24. The restricting lug 25 is fitted in the restricting notch 11 of the insertion hole 10 when the first and second ceiling plate supporting stringers are connected.

The main plate portion 4, the base plate portion 21 and the connecting projection 22 are formed of a steel metal plate with high resiliency.

An end of the second ceiling panel supporting stringer 1 can be connected to the main plate portion of the first ceiling panel supporting stringer 1 only by pressingly inserting the connecting projection 22 of the second ceiling panel supporting stringer 1 into the insertion hole 10 of the first ceiling panel supporting stringer 1 as shown in FIG. 6(A) and FIG. 6(B). Then, the U-shaped rise 24 is engaged with one side edge of the insertion hole 10 and elastically deformed until it becomes generally parallel to the base plate portion 21, allowing insertion of the connecting projection 22 through the insertion hole 10. When the connecting projection 22 is further inserted, the end (e) of the base plate portion 21 abuts against the main plate portion 4 of the first ceiling panel supporting stringer 1. At this position, the U-shaped rise 24 is released from the side edge of the insertion hole 10 and tends to restore to its original position (see FIG. 6(B)). At this time, the restricting lug 25 is fitted in the restricting notch 11 (see FIG. 6(B')). In this state, the restricting lug 25 is held in elastic engagement with the side edge of the restricting notch 11, so that the U-shaped rise cannot be fully restored.

In this state, even when the second ceiling panel supporting stringer 1 receives a tension to pull it off the first ceiling panel supporting stringer 1, the free edge 24*a* of the U-shaped rise 24 abuts against the main plate portion 4 of the first ceiling panel supporting stringer 1 beside the insertion hole 10 (see FIG. 6(B)) and prevents the connecting projection 22 from being withdrawn from the insertion hole 10. Also, the free edge 24*a* of the U-shaped rise 24 is restrained from fully restoring because of the restricting notch 11 (see FIG. 6(B')), the U-shaped rise 24 is prevented from being lifted outward and deformed by the tension.

The connection of the first and second ceiling panel supporting stringers 1 can be released only by pressing the restricting lug 25 protruding from the insertion hole 10 until it becomes parallel to the base plate portion 21 with a screwdriver or the like. Thereby, the free edge 24*a* of the U-shaped rise 24 is located in the insertion hole 10 and released from restraint, allowing withdrawal of the connecting projection 22 from the insertion hole 10.

The U-shaped rise 24 can be formed only by cutting and raising the center portion of the connecting projection 22 without complicated folding process. Thus, the production process of the ceiling panel supporting stringer 1 can be facilitated. Also, the base plate portion 21, the connecting projection 22 and the main plate portion 4, which are integrally formed, can be simultaneously formed by press working with high production efficiency.

In addition to the above configuration, various configurations are possible. Description will be hereinafter made of the other configurations.

Figure 7:
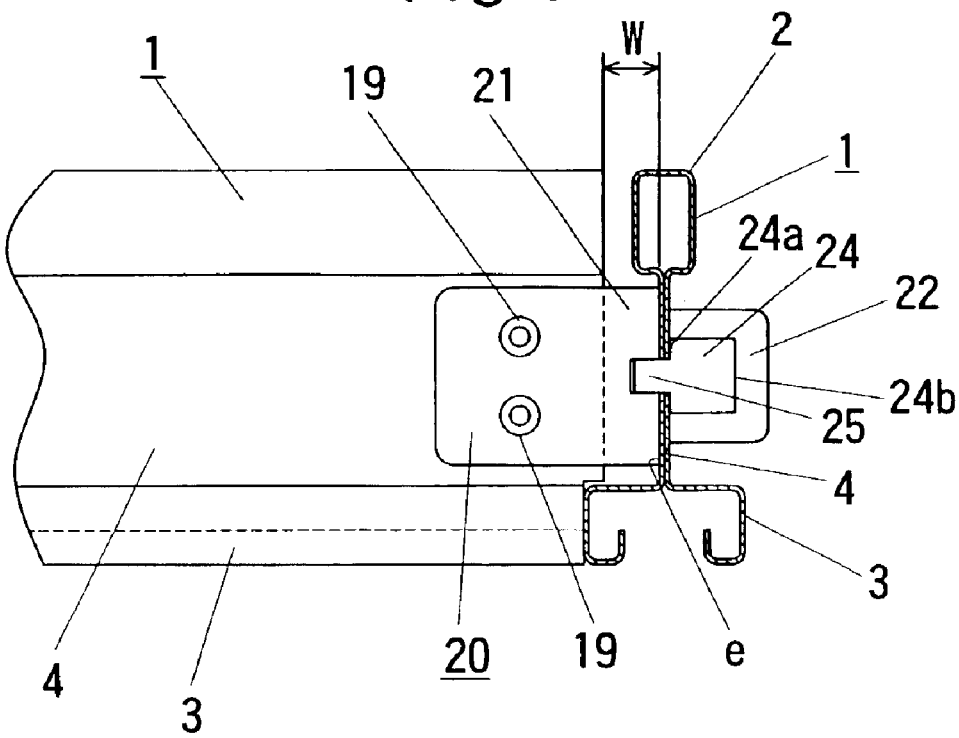
FIG. 7 is a vertical cross-sectional side view illustrating a connecting plate 20 according to a second embodiment.

FIG. 7 shows a configuration in which a connecting plate 20 formed of a steel metal plate with high resiliency is secured to the main plate portion 4 with screws 19 and 19 (second embodiment). The connecting plate 20 comprises a base plate portion 21 secured to the main plate portion 4 such that an end thereof protrudes from an end of the ceiling panel supporting stringer 1 for a length corresponding to the width W of the engaging edge 3, and a connecting projection 22 extending from the base plate portion 21. The ceiling panel supporting stringer 1 is so long that it is difficult to machine. With the above configuration, however, the connecting plate 20 can be produced separately from the primary portion of the ceiling panel supporting stringer 1, so that the entire production process of the ceiling panel supporting stringer 1 can be facilitated.

Figure 8:
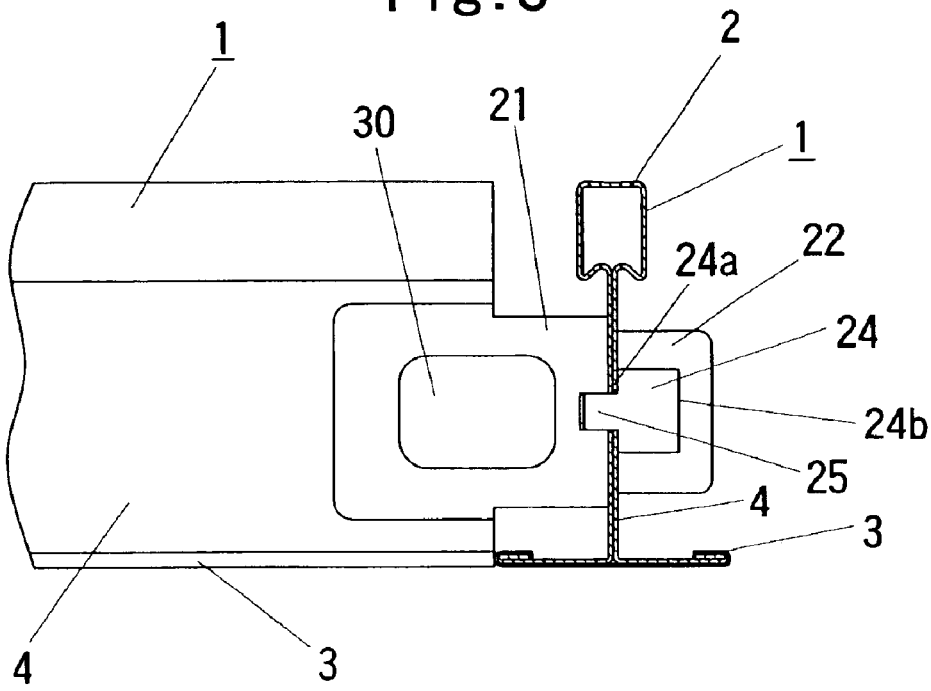
FIG. 8 is a vertical cross-sectional side view illustrating a connecting mechanism for ceiling panel supporting stringers 1 according to a third embodiment.

FIG. 8 shows a configuration in which a reinforcing bulge 30 bulged in a thickness direction of the main plate portion 4 is provided across the border of the main plate portion 4 and the base plate portion 21 (third embodiment). With this configuration, the rigidity of the base plate portion 21 is improved and the ceiling panels p can be supported with stability. Since the reinforcing bulge 30 can be simultaneously formed in the process of press working for forming the base plate portion 21 and so on, the entire production process of the ceiling panel supporting stringer 1 is not increased.

Figure 9:
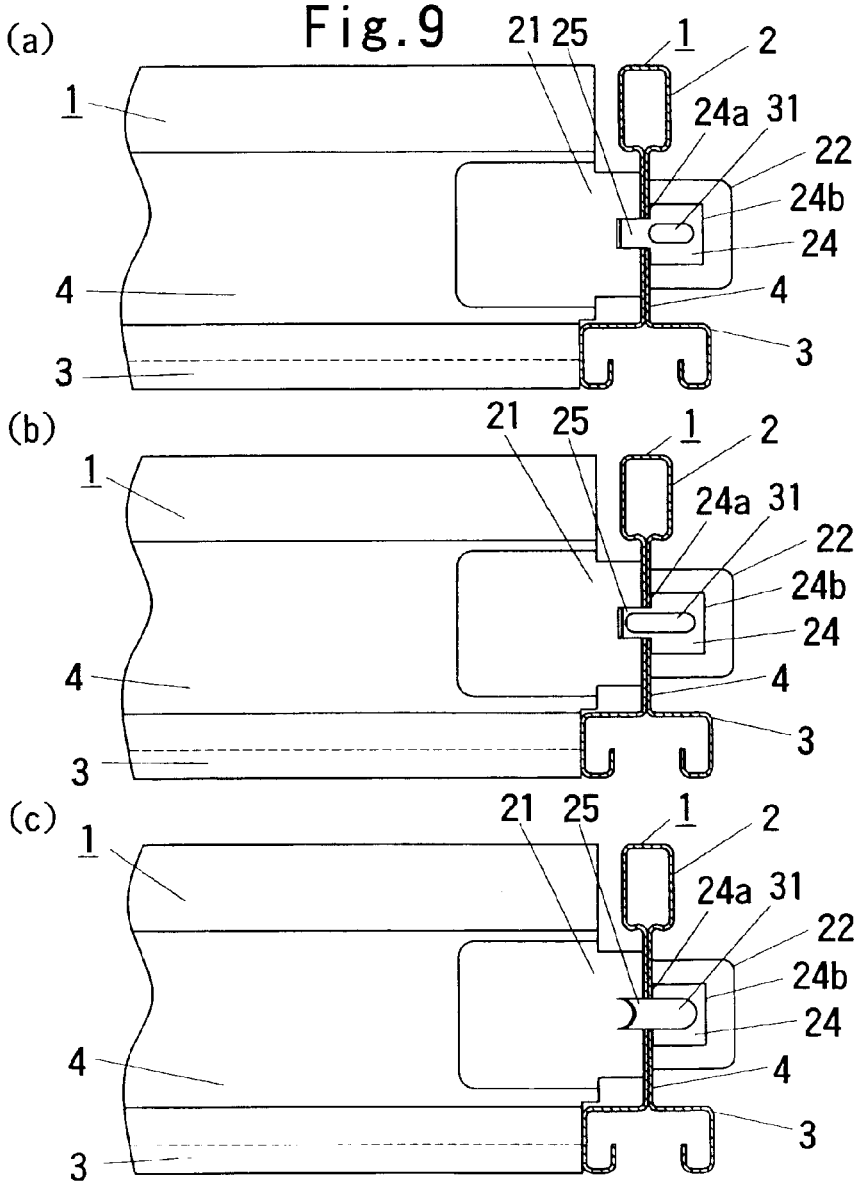
FIG. 9(*a*) illustrates a configuration of a reinforcing rib 31 of a U-shaped rise 24 according to a fourth embodiment.

Each of FIG. 9(*a*) to FIG. 9(*c*) shows a configuration in which the U-shaped rise 24 has a reinforcing rib 31 bulged in a thickness direction thereof (fourth embodiment). FIG. 9(*a*) shows a configuration in which the reinforcing rib 31 is formed at a center portion of the U-shaped rise 24. FIG. 9(*b*) shows a configuration in which the reinforcing rib 31 extends to the restricting lug 25. FIG. 9(*c*) shows a configuration in which the reinforcing rib 31 is formed on the U-shaped rise 24 by curving the restricting lug 25. In these configurations, the reinforcing rib 31 improves the longitudinal rigidity of the U-shaped rise 24 and prevents the U-shaped rise 24 and the restricting lug 25 from buckling. Reinforcing ribs 31 may be formed on both sides of the U-shaped rise 24.

Figure 10:
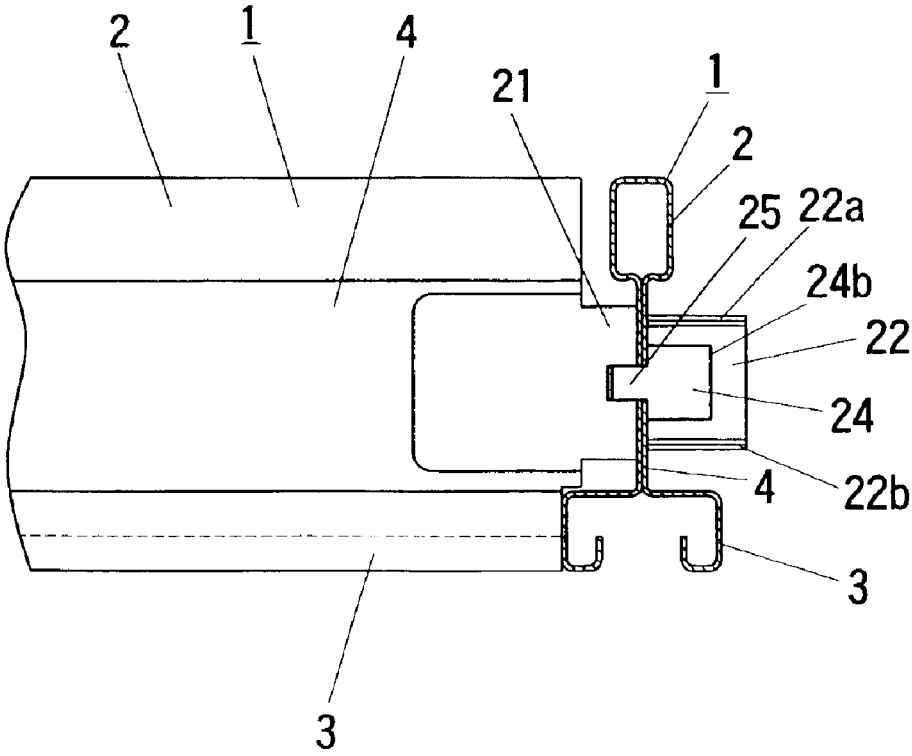
FIG. 10 is a vertical cross-sectional side view illustrating a connecting mechanism for ceiling panel supporting stringers 1 according to a fifth embodiment.
Figure 11:
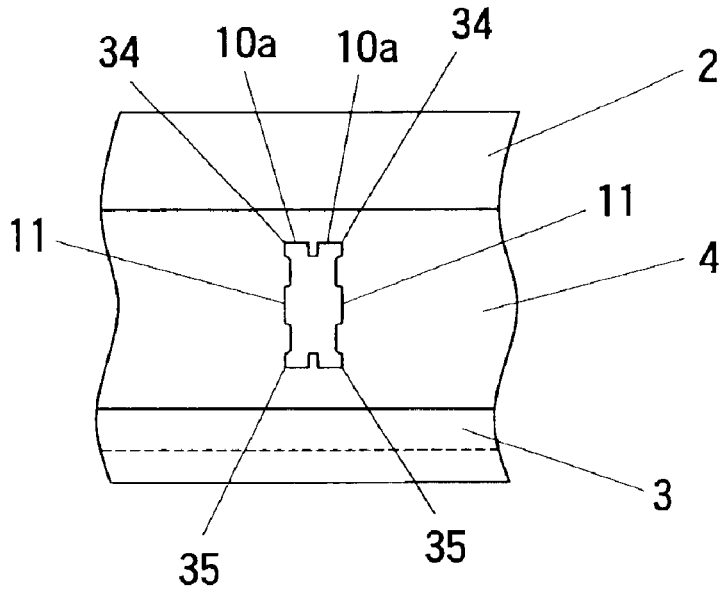
FIG. 11(A) is a front view illustrating an insertion hole 10*a* according to the fifth embodiment.
FIG. 11(B) is a vertical cross-sectional side view illustrating a connecting projection 22 according to the fifth embodiment after insertion through the insertion hole 10*a;*
Figure 11:
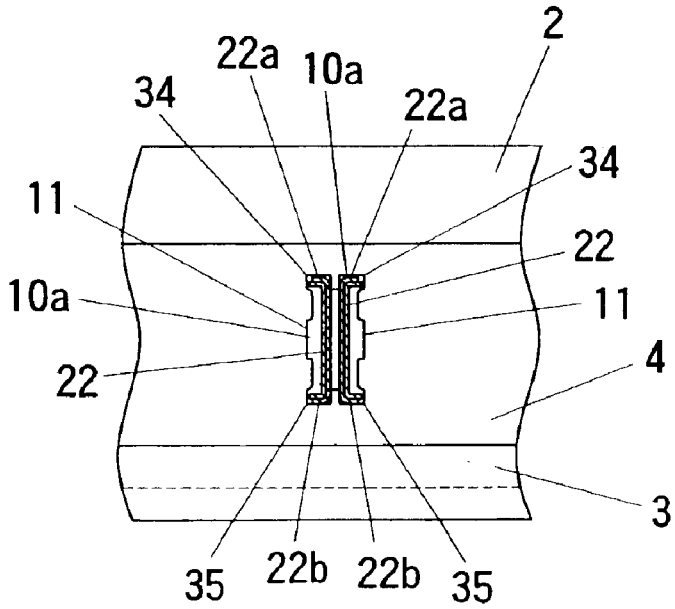

FIG. 10 shows a configuration in which the upper edge 22*a* and lower edge 22*b* of the connecting projection 22 are bent in the rising direction of the U-shaped rise 24 by about 90 degrees to prevent the connecting projection 22 from buckling (fifth embodiment). In this case, an upper edge passing hole 34 and a lower edge passing hole 35 are formed at the uppermost part and the lowermost part, respectively, of the side edge of each of the insertion hole 10*a* as shown in FIG. 11(B). The upper edge passing hole 34 and the lower edge passing hole 35 are formed continuously with the insertion hole 10*a*.

The upper edge passing hole 34 and the lower edge passing hole 35 prevent the upper edge 22*a* and the lower edge 22*b* of the second ceiling panel supporting stringer 1 from interfering with the main plate portion 4 of the first ceiling panel supporting stringer 1 when the connecting projection 22 of the second ceiling panel supporting stringer 1 is pressingly inserted through the insertion hole 10 of the first ceiling panel supporting stringer 1. Thereby, the connecting projection 22 can be properly inserted into the insertion hole 10*a* as shown in FIG. 11(B) and the first and second ceiling panel supporting stringers 1 can be connected properly.

Figure 12:
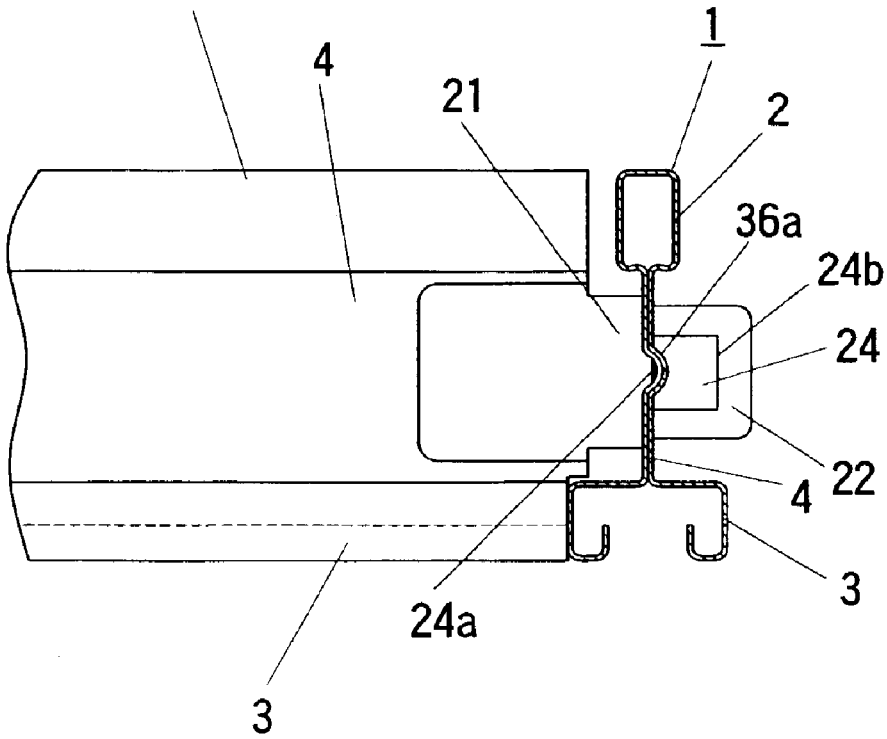
FIG. 12 is a vertical cross-sectional side view illustrating a connecting mechanism for ceiling panel supporting stringers 1 according to a sixth embodiment.
Figure 13:
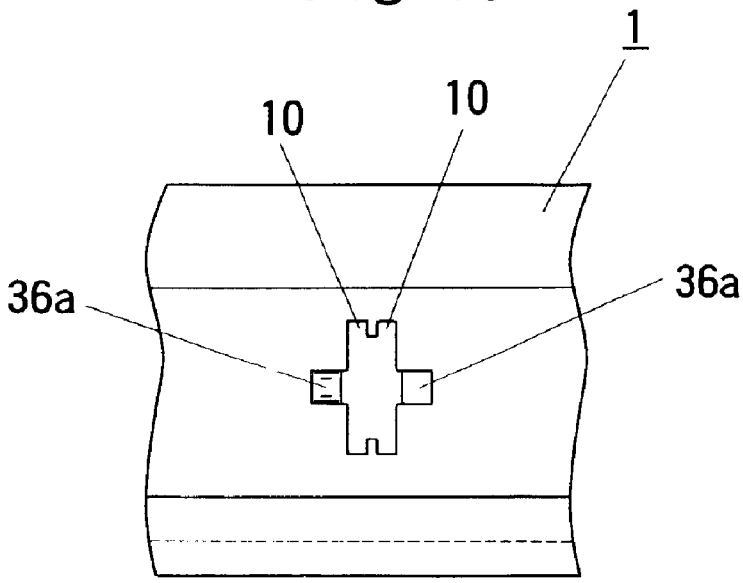
FIG. 13 is a front view illustrating an insertion hole 10 of the ceiling panel supporting stringer 1 according the sixth embodiment.
Figure 14:
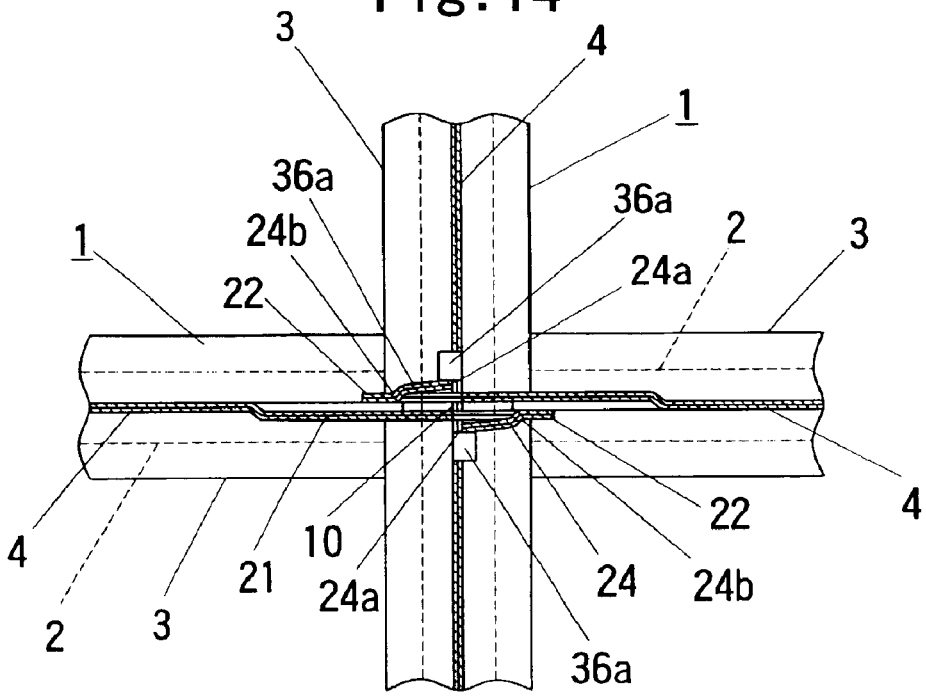
FIG. 14 is a transverse cross-sectional plan view of a connecting mechanism for ceiling panel supporting stringers 1 according to the sixth embodiment.

FIG. 12 to FIG. 14 show a configuration in which the U-shaped rise 24 does not have the restricting projection 25, and a restricting projection 36*a* with which the free edge 24*a* of the U-shaped rise 24 is elastically engageable is formed beside the insertion hole 10 (sixth embodiment). The restricting projection 36*a*, which protrudes in a semicircular shape in a thickness direction of the first ceiling panel supporting stringer 1 as shown in FIG. 12 and FIG. 13, can be formed by swaging.

When the connecting projection 22 of the second ceiling panel supporting stringer 1 is pressingly inserted into the insertion hole 10 of the first ceiling panel supporting stringer 1, the end (e) of the base plate portion 21 of the second ceiling panel supporting stringer 1 abuts against one side of the main plate portion 4 of the first ceiling panel supporting stringer 1. Then, the U-shaped rise 24 rises outward and the free edge 24*a* thereof elastically engages the restricting projection 36*a* as shown in FIG. 14. Thereby, the connecting projection 22 is fitted in the insertion hole 10 without looseness in the width direction of the insertion hole 10. Also, when the second ceiling panel supporting stringer 1 receives a tension to pull it off the first ceiling panel supporting stringer 1, the U-shaped rise 24 is prevented from being lifted outward by the restricting projection 36*a*. Namely, there can be obtained effects similar to those of the configuration in which the U-shaped rise 24 has the restricting lug 25.

Figure 15:
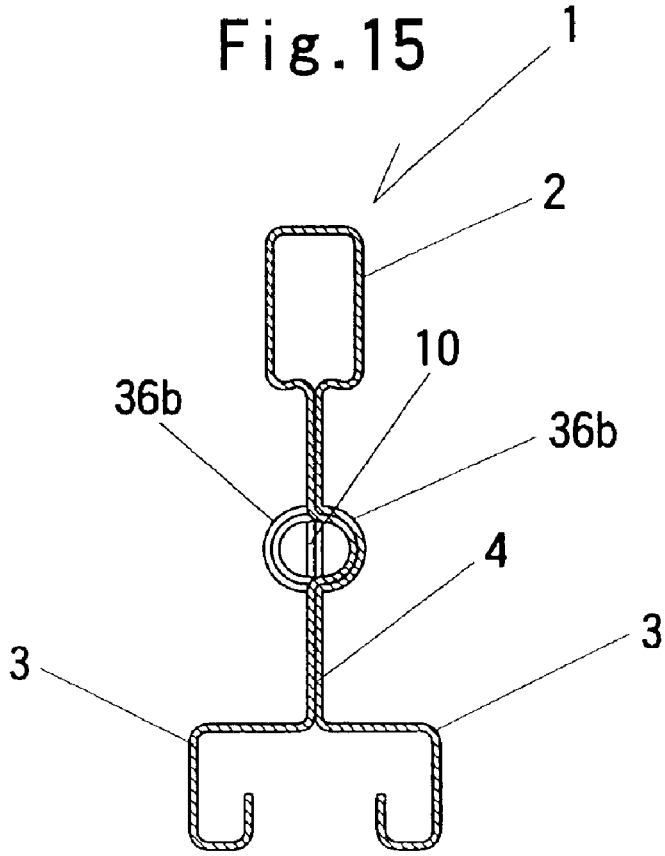
FIG. 15 is a vertical cross-sectional side view of a ceiling panel supporting stringer 1 provided with a restricting projection 36*b;*

As shown in FIG. 15, the ceiling panel supporting stringer 1 may have restricting projections 36*b* which is larger in size than the restricting projection 36*a* shown in FIG. 12. The shape of the restricting projections 36*a* and 36*b* may be changed as necessary.

Figure 16:
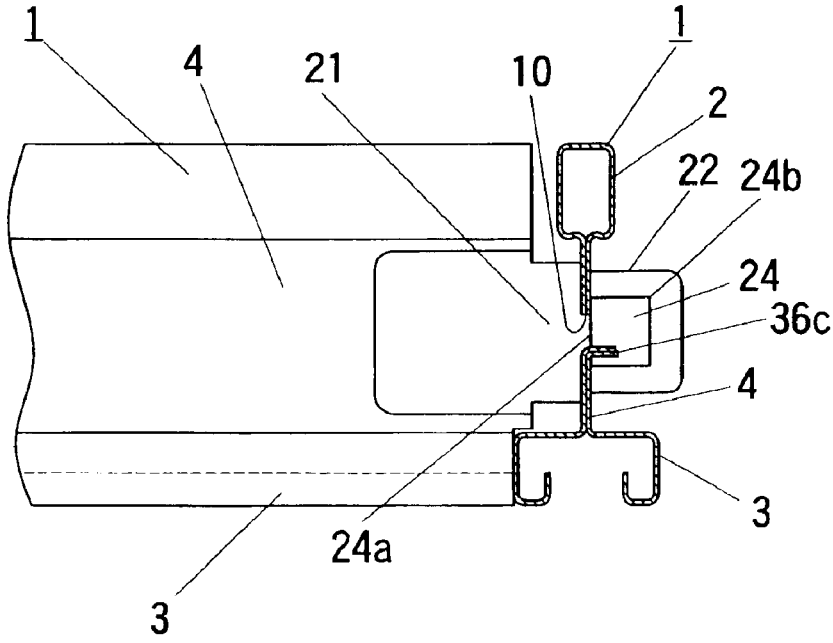
FIG. 16 is a vertical cross-sectional side view illustrating a connecting mechanism for ceiling panel supporting stringers 1 according to a seventh embodiment.
Figure 17:
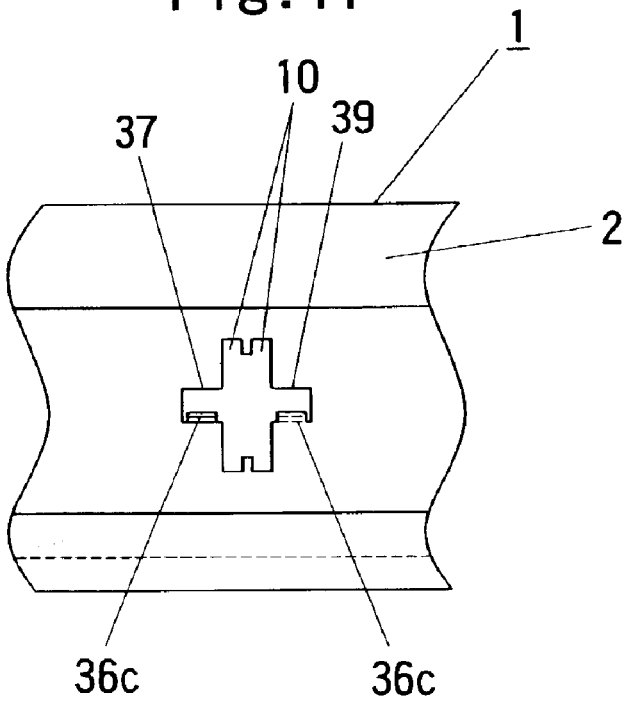
FIG. 17 is a front view illustrating an insertion hole 10 according to the seventh embodiment.
Figure 18:
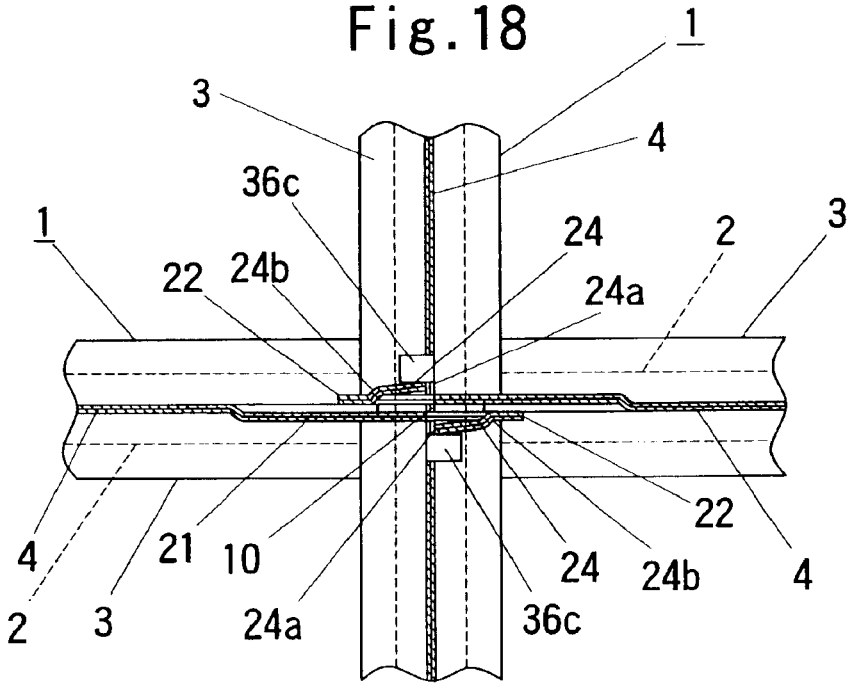
FIG. 18 is a transverse cross-sectional plan view illustrating a connecting mechanism for ceiling panel supporting stringers 1 according to the seventh embodiment.

FIG. 16 to FIG. 18 show a configuration in which an inverted L-shaped recess 37 (see FIG. 17) is formed in a side edge of each of the insertion holes 10, and an uncut-off linear portion is bent at a right angle (see FIG. 16) to form a restricting projection 36*c* (seventh embodiment). When the connecting projection 22 of the second ceiling panel supporting stringer 1 is pressingly inserted through the insertion hole 10 of the first ceiling panel supporting stringer 1, the U-shaped rise 24 of the second ceiling panel supporting stringer 1 rises outward and the free edge 24*a* elastically engages the restricting projection 36*c* of the first ceiling panel supporting stringer 1 as shown in FIG. 18. Thereby, the first and second ceiling panel supporting stringers 1 are held in connection with each other.

Figure 19:
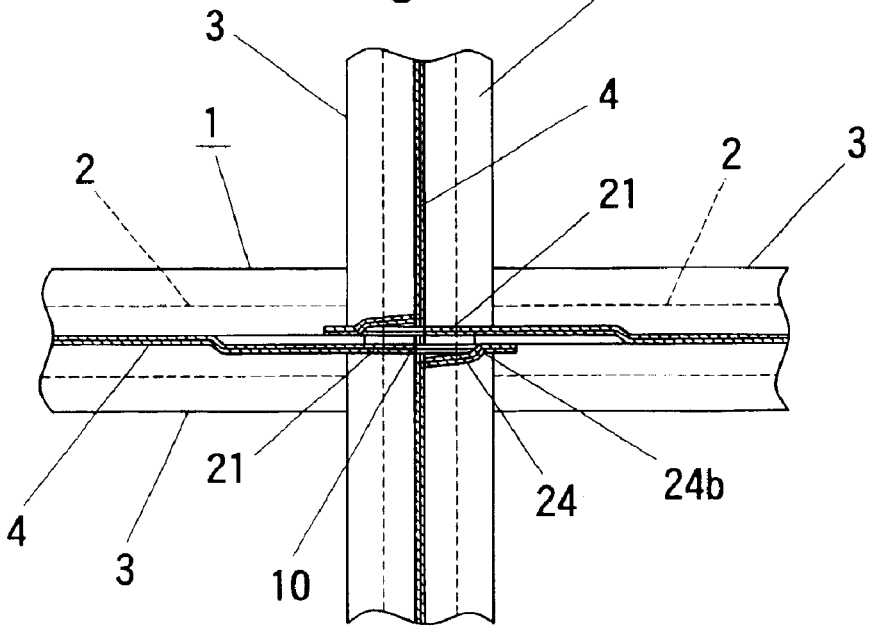
FIG. 19 is a transverse cross-sectional plan view illustrating a connecting mechanism for ceiling panel supporting stringers 1 according to an eighth embodiment.
Figure 20:
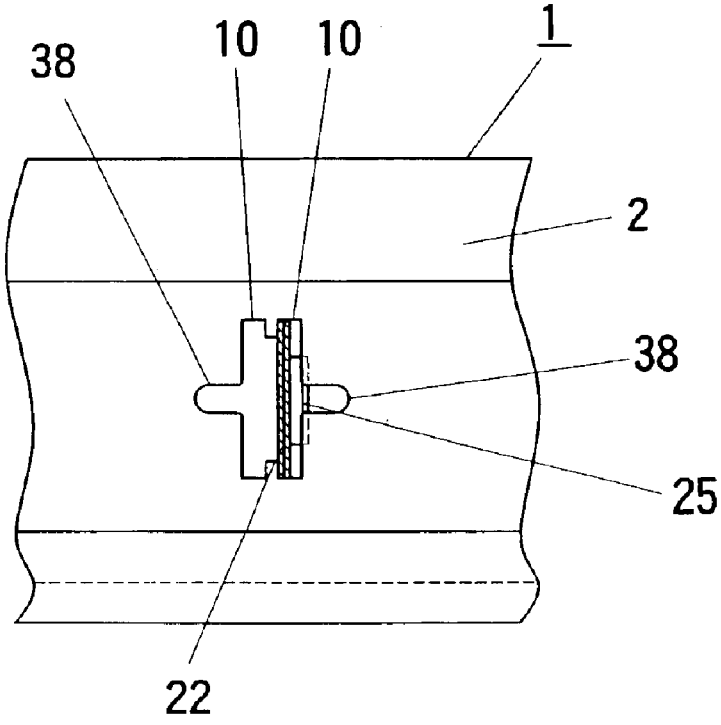
FIG. 20 is a vertical cross-sectional side view illustrating a connecting mechanism for ceiling panel supporting stringers 1 according to the eighth embodiment.

The first to seventh embodiments are provided with the restricting projection 25 or the restricting projection 36*a*, 36*b* or 36*c* so that the first and second ceiling panel supporting stringers 1 can be held in connection with each other. However, as shown in FIG. 19, the restricting projection 25 or the restricting projection 36*a*, 36*b* or 36*c* may be omitted (eighth embodiment). In this case, the connected ceiling panel supporting stringers 1 can be separated by inserting a thin rod-like tool such as a pin drill through a release notch 38 formed in the middle of the side edge of the insertion hole 10 and pressing the U-shaped rise 24 until it becomes parallel to the base plate portion 21 with the tip of the tool as shown in FIG. 20. Then, the U-shaped rise 24 is elastically deformed and the free edge 24*a* of the U-shaped rise 24 is located in the insertion hole 10, whereby the U-shaped rise 24 is released from the side edge of the insertion hole 10 and the connecting projection 22 can be easily withdrawn from the insertion hole 10.

The insertion holes 10 and 10, which are vertically rectangular, may be square or horizontally rectangular. The shape of the insertion holes 10 and 10 may be changed depending upon the shape of the connecting projection 22.

Figure 21:
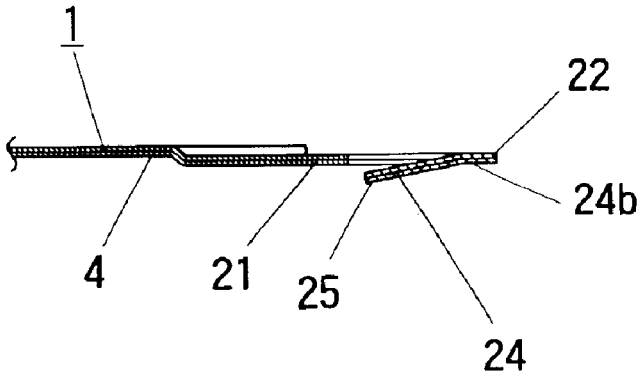
FIG. 21 is a transverse cross-sectional plan view illustrating the connecting projection 22 of another configuration.

The U-shaped rise 24, which is of U-shape as viewed from a side, may be of substantially C shape or may be substantially triangular. The connecting base 24*b* of the U-shaped rise 24, which is rounded, may not be rounded as shown in FIG. 21. In this case, the strength in the longitudinal direction of the U-shaped rise 24 is improved, so that the U-shaped rise 24 can be prevented from being buckled or deformed.

Description will be made of a ninth embodiment with reference to FIG. 22 to FIG. 24.

Figure 22:
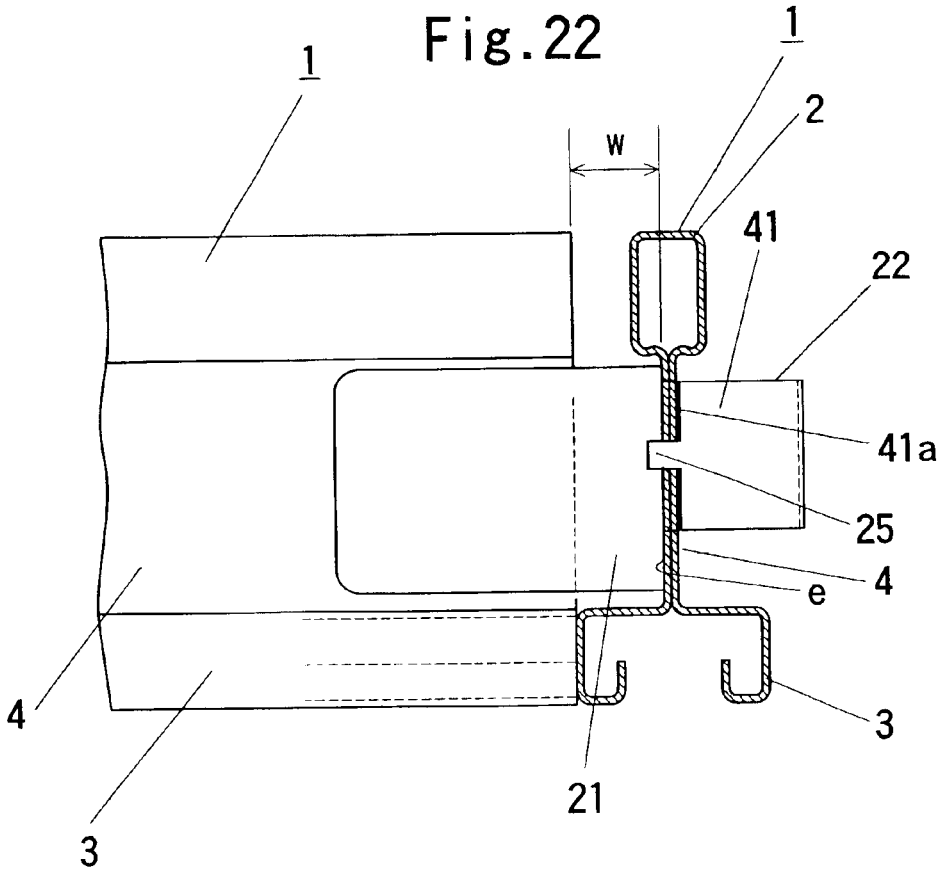
FIG. 22 is a vertical cross-sectional side view illustrating a connecting mechanism for ceiling panel supporting stringers 1 according to a ninth embodiment.
Figure 23:
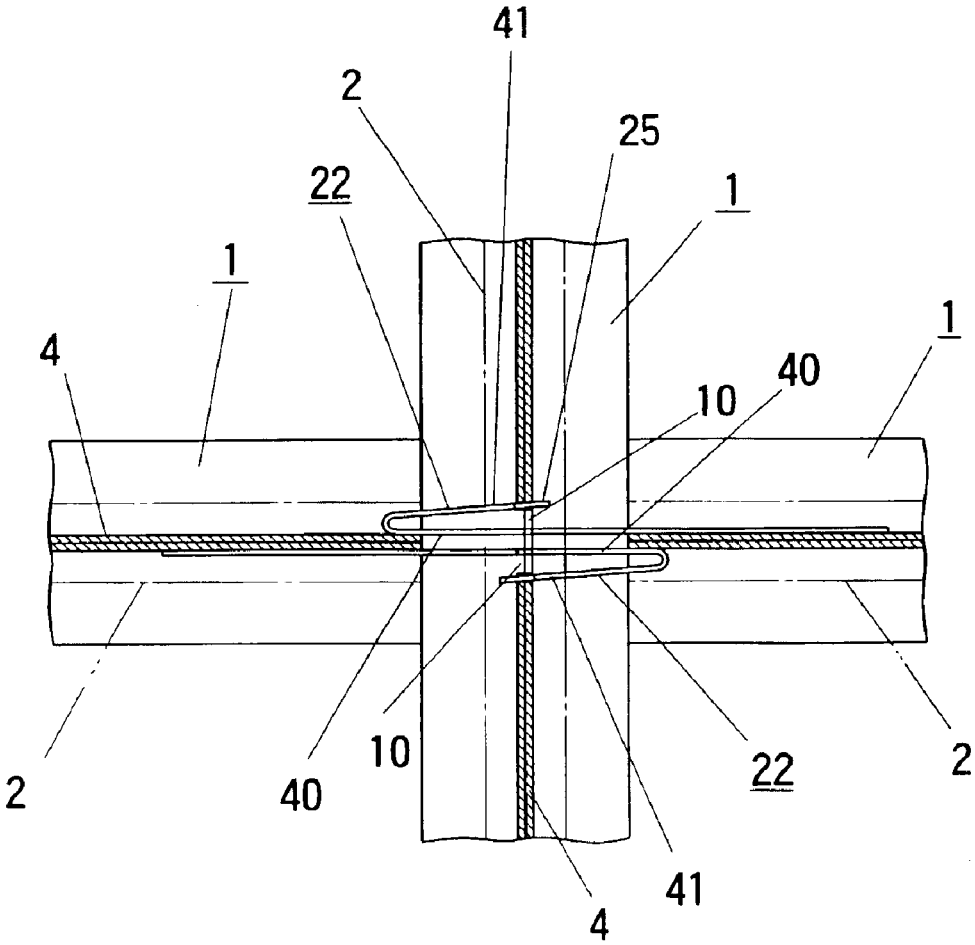
FIG. 23 is a transverse cross-sectional plan view illustrating a connecting mechanism for ceiling panel supporting stringers 1 according to the ninth embodiment.
Figure 24:
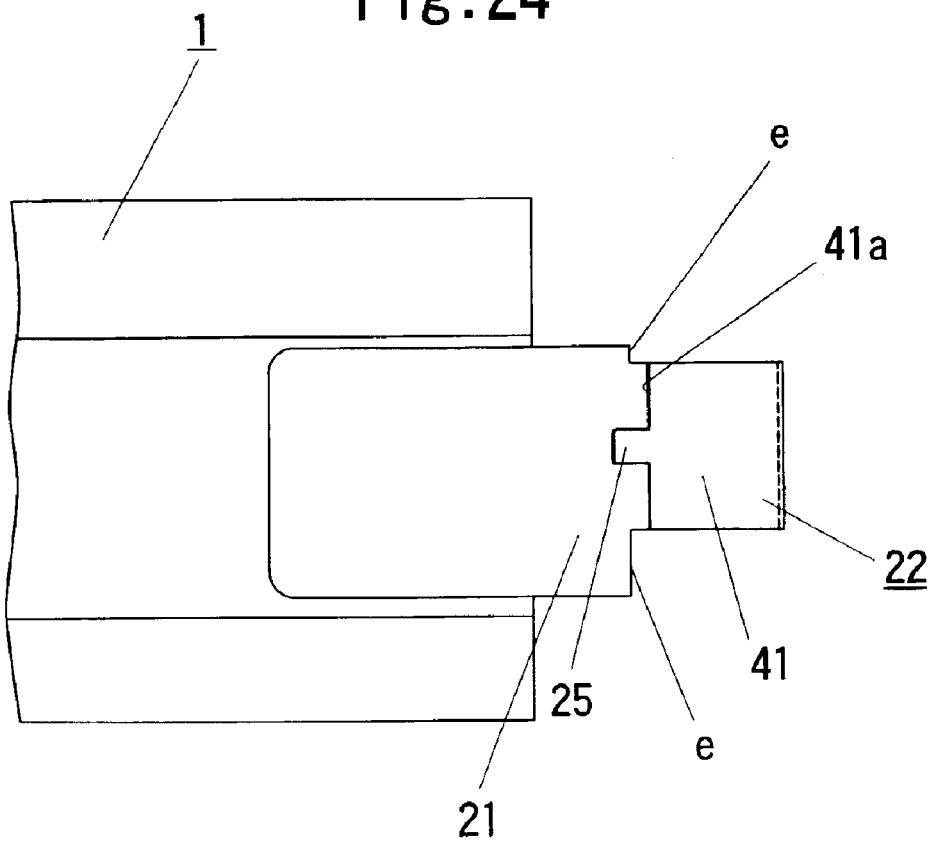
FIG. 24 is a front view illustrating a connecting projection 22 according to the ninth embodiment.

As shown in FIG. 22 to FIG. 24, the second ceiling panel supporting stringer 1 has a connecting projection 22 comprising a base plate portion 21, a linear portion 40 (see FIG. 23) extending from the end (e) of the base plate portion 21 and a folded portion 41 folded back at an angle of almost 180 degrees from the linear portion 40 and having an end edge 41*a*. The vertical length of the folded portion 41 is almost the same as that of the insertion hole 10, and the distance between the end (e) of the base plate portion 21 and the end edge 41*a* of the folded portion 41 is almost the same as the thickness of the main plate portion 4 of the ceiling panel supporting stringer 1. A restricting lug 25 protrudes from an intermediate portion of the end edge 41*a* of the folded portion 41. The folded portion 41 is slightly raised outward from the linear portion 40. The folded portion 41 constitutes a backward projection according to the present invention.

An end of the second ceiling panel supporting stringer 1 can be connected to the main plate portion 4 of the first ceiling panel supporting stringer 1 only by pressingly inserting the connecting projection 22 of the second ceiling panel supporting stringer 1 into the insertion hole 10 of the first ceiling panel supporting stringer 1. Then, the folded portion 41 is engaged with one side edge of the insertion hole 10 and elastically deformed until it becomes almost parallel to the linear portion 40, allowing insertion of the connecting projection 22 through the insertion hole 10. When the connecting projection 22 is further inserted, the end (e) of the base plate portion 21 abuts against the main plate portion 4 of the first ceiling panel supporting stringer 1. At this position, the folded portion 41 is released from the edge of the insertion hole 10 and tends to restore to its original position. At this time, the restricting lug 25 is fitted in the restricting notch 11. Thereby, the first and second ceiling panel supporting stringers 1 are held in connection with each other.

In this state, even when the second ceiling panel supporting stringer 1 receives a tension to pull it off the first ceiling panel supporting stringer 1, the end edge 41*a* of the folded portion 41 abuts against the main plate portion 4 of the first ceiling panel supporting stringer beside the insertion hole 10 and prevents the connecting projection 22 from being withdrawn from the insertion hole 10. Also, the end edge 41*a* of the folded portion 41 is restrained from fully restoring by the restricting notch 11 (see FIG. 23), the folded portion 41 is prevented from being lifted outward and deformed by the tension.

The connection of the first and second ceiling panel supporting stringers 1 can be released only by pressing the restricting lug 25 protruding from the insertion hole 10 until it becomes parallel to the base plate portion 21 with a screwdriver or the like. Thereby, the edge 41*a* of the folded portion 41 is located in the insertion hole 10 and released from restraint, allowing withdrawal of the connecting projection 22 from the insertion hole 10.

Another embodiment will be described.

Figure 25:
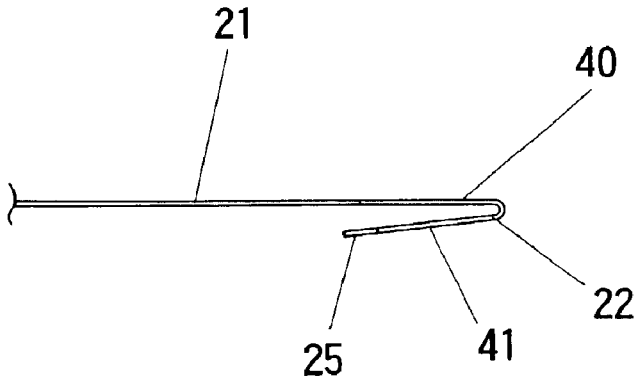
FIG. 25(A) is a front view illustrating a connecting projection 22 according to a tenth embodiment.
FIG. 25(B) is a side view illustrating the connecting projection 22 according to the tenth embodiment.
Figure 25:
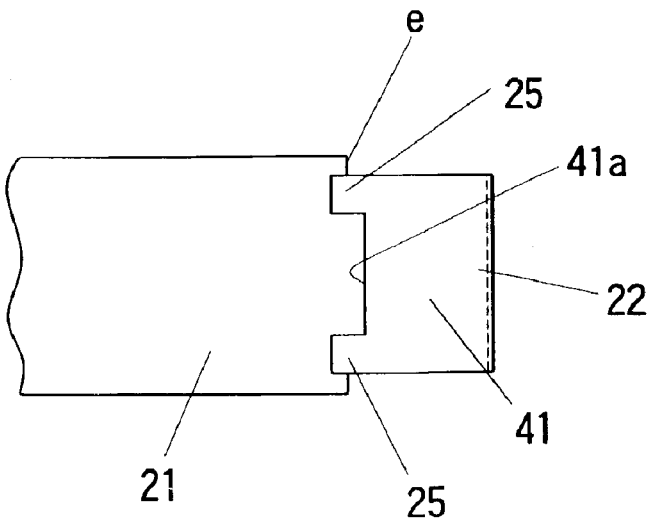
Figure 26:
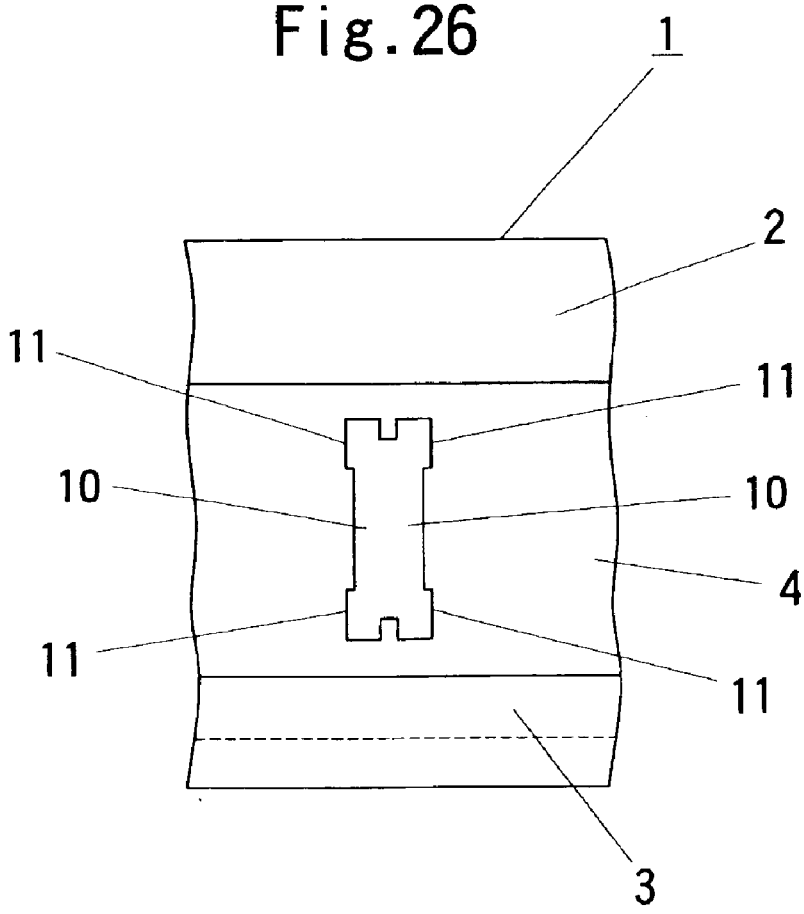
FIG. 26 is a front view illustrating an insertion hole 10 of a ceiling panel supporting stringer 1 according to the tenth embodiment.

FIG. 25(A), FIG. 25(B) and FIG. 26 show a configuration in which two restricting lugs 25 protrudes from the upper and lower end of the folded portion 41, and two restricting notches 11 engageable with the restricting lugs 25 are formed in the upper and lower ends of the side edge of the insertion hole 10 (tenth embodiment). With this configuration, when a moment is applied to the second ceiling plate supporting stringer in a vertical direction thereof, a large resisting force is obtained.

Figure 27:
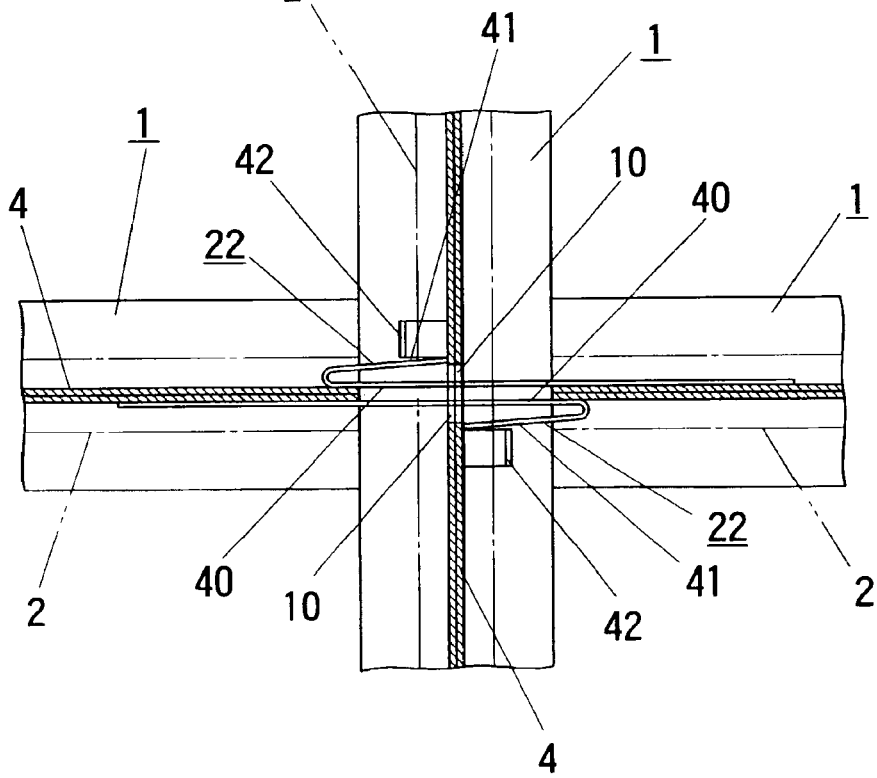
FIG. 27 is a transverse cross-sectional plan view of a connecting mechanism for ceiling panel supporting stringers 1 according to an eleventh embodiment.

FIG. 27 shows a configuration in which a restricting projection 42, with which the end edge 41*a* of the folded portion 41 of the second ceiling panel supporting stringer 1 is elastically engageable, is formed beside the insertion hole 10 of the first ceiling panel supporting stringer 1 instead of providing the restricting lug 25 to the folded portion of the second ceiling panel supporting stringer 1 (eleventh embodiment). When the connecting projection 22 of the second ceiling panel supporting stringer 1 is pressingly inserted through the insertion hole 10 of the first ceiling panel supporting stringer 1, the end (e) of the base plate portion 21 abuts against a side of the main plate portion 4 of the second ceiling panel supporting stringer 1. Then, the folded portion 41 rises outward and the edge 41*a* thereof elastically engages the restricting projection 36*a* as shown in FIG. 14. Thus, the connecting projection 22 is fitted in the insertion hole 10 without looseness in the width direction of the insertion hole 10. When the second ceiling panel supporting stringer 1 receives a tension to pull it off the first ceiling panel supporting stringer 1, the folded portion 41 is prevented from being lifted outward. Namely, there can be obtained effects similar to those of the configuration in which the folded portion 41 has the restricting lug 25.

Each of the restricting projections 42 is constituted in the same manner as those in the seventh embodiment described before.

According to the present invention, the connecting mechanism for ceiling panel supporting stringers comprises:

an insertion hole formed through a main plate portion of a first ceiling panel supporting stringer;

a base plate portion extending from an end of a second ceiling panel supporting stringer and having a forward end;

a connecting projection extending from the forward end of the base plate portion; and a backward projection extending from the connecting projection and having an end edge, whereby, when the connecting projection of the second ceiling panel supporting stringer is pressingly inserted through the insertion hole of the first ceiling panel supporting stringer, the forward end of the connecting projection of the second ceiling panel supporting stringer abuts against one side of the main plate portion of the first ceiling panel supporting stringer and the end edge of the backward projection of the second ceiling panel abuts against the other side of the main plate portion of the first ceiling panel supporting stringer beside the insertion hole to prevent the connecting projection of second ceiling panel supporting stringer from being withdrawn from the insertion hole of the first ceiling panel supporting stringer. Thus, the first and second ceiling panel supporting stringers can be easily connected only by pressingly inserting the connecting projection of the second ceiling panel supporting stringer into the insertion hole of the first ceiling panel supporting stringer without special skills.

When the first ceiling plate supporting stringer is provided with a restricting notch formed in a side edge of the insertion hole and the second ceiling plate supporting stringer is provided with a restricting lug engageable with the restricting notch and projecting from the end edge of the backward projection, the restricting lug elastically engages a side edge of the restricting notch, so that the connecting projection is fitted in the insertion hole without looseness in the width direction of the insertion hole. Thereby, the ceiling panel supporting stringers can be held in stable connection with each other. Also, even when the second ceiling panel supporting stringer receives a tension to pull it off the first ceiling panel supporting stringer, the backward projection is prevented from being lifted outward, so that the first and second ceiling panel supporting stringers can be strongly held. In addition, the first and second ceiling panel supporting stringers can be easily separated by pressing the restricting lug toward the base plate portion.

When the first ceiling panel supporting stringer is provided with a restricting projection which is formed on the main plate portion beside the insertion hole and with which the end edge of the backward projection is elastically engageable, the backward projection rises and the end edge thereof elastically engages the restricting projection, so that the connecting projection is fitted in the insertion hole without looseness in the width direction of the insertion hole. Also, even when the second ceiling panel supporting stringer receives a tension to pull it off the first ceiling panel supporting stringer, the backward projection is prevented from being lifted outward, so that the first and second ceiling panel supporting stringers can be held with stability.

When the backward projection is provided with a reinforcing rib protruding in the thickness direction thereof, the rigidity of the backward projection can be improved without additional machining since the reinforcing rib can be formed by press working simultaneously with the connecting projection. Thereby, the first and second ceiling panel supporting stringers can be strongly held with stability.

When the backward projection is provided with reinforcing ribs protruding from both side thereof, the rigidity of the backward projection can be further improved.

When the base plate portion and the connecting projection are integrally formed with the main plate portion of the ceiling panel supporting stringer, the base plate portion, the connecting projection and the main plate portion can be formed simultaneously by press working. Thus, the ceiling panel supporting stringer can be produced with high production efficiency.

When a connecting plate comprising the base plate portion and the connecting projection is joined to one side of the main plate portion of the ceiling panel supporting stringer, the connecting plate can be easily formed by cutting and raising a metal plate without machining the ceiling panel supporting stringer, which is so long that it is difficult to machine.

When the backward projection of the connecting projection comprises a folded portion formed by folding back the connecting projection at about 180 degrees and shaped such that the distance from the end edge thereof to the forward end of the base plate portion is generally the same as the thickness of the main plate portion of the ceiling panel supporting stringer, the first and the second ceiling panel supporting stringers can be easily connected by pressingly inserting the connecting projection of the second ceiling panel supporting stringer through the insertion hole of the first ceiling panel supporting stringer without special skills.

When the backward projection of the connecting projection comprises a U-shaped rise raised in the thickness direction of the connecting projection so that, when the connecting projection of the second ceiling panel supporting stringer is pressingly inserted through the insertion hole of the first ceiling panel supporting stringer, the free edge of the U-shaped rise can abut against the other side of the main plate portion of the first ceiling panel supporting stringer beside the insertion hole to prevent the connecting projection from being withdrawn from the insertion hole, the first and the second ceiling panel supporting stringers can be easily connected by pressingly inserting the connecting projection of the second ceiling panel supporting stringer through the insertion hole of the first ceiling panel supporting stringer without special skills. Also, the U-shaped rise can be formed without preprocessing such as bending, so that the production process of the ceiling panel supporting stringer can be facilitated, enhancing production efficiency and reducing production costs.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A connecting mechanism for connecting first and second ceiling panel supporting stringers in a T configuration, each of said ceiling panel supporting stringers comprising a main plate portion having a lower end and engaging edges extending from said lower end of said plate portion for supporting edges of ceiling panels, said connecting mechanism comprising:

an insertion hole formed through said main plate portion of said first ceiling panel supporting stringer;

a base plate portion extending from an end of said second ceiling panel supporting stringer and having a forward end;

a connecting projection extending in the same direction as the extending direction of said base plate portion from said forward end of said base plate portion and having a vertical length which is generally the same as that of said insertion hole; and a backward projection extending at an angle of about 180 degrees from said connecting projection and having an end edge, said backward projection being shaped such that the distance from said end edge to said forward end of said base plate portion is generally the same as the thickness of said main plate portion of said ceiling panel supporting stringer, wherein said backward projection of said connecting projection comprises a U-shaped raised portion raised in the thickness direction of said connecting projection and having a forward edge continuous with said connecting projection and the free backward edge, said U-shaped raised portion being shaped such that the distance from said free backward edge to said forward end of said base plate portion is generally the same as the thickness of said main plate portion of said ceiling panel supporting stringer, whereby, when said connecting projection of said second ceiling panel supporting stringer is pressingly inserted through said insertion hole of said first ceiling panel supporting stringer, said forward end of said connecting projection of said second ceiling panel supporting stringer abuts against one side of said main plate portion of first ceiling panel supporting stringer and said free end edge of said U-shaped raised portion of said second ceiling panel abuts against the other side of said main plate portion of said first ceiling panel supporting stringer beside said insertion hole to prevent said connecting projection of second ceiling panel supporting stringer from being withdrawn from said insertion hole of said first ceiling panel supporting stringer.

2. The connecting mechanism for ceiling panel supporting stringers as claimed in claim 1, further comprising a restricting notch formed in a side edge of said insertion hole and a restricting lug engageable with said restricting notch and projecting from said end edge of said backward projection.

3. The connecting mechanism for ceiling panel supporting stringers as claimed in claim 2, wherein said backward projection is provided with a reinforcing rib protruding in the thickness direction thereof.

4. The connecting mechanism for ceiling panel supporting stringers as claimed in claim 2, wherein said backward projection of said connecting projection comprises a folded portion formed by folding back said connecting projection at about 180 degrees and having an end edge, said folded portion being shaped such that its vertical length is generally the same as that of said insertion hole and the distance from said end edge to said forward end of said base plate portion is generally the same as the thickness of said main plate portion of said ceiling panel supporting stringer, whereby, when said connecting projection of said second ceiling panel supporting stringer is pressingly inserted through said insertion hole of said first ceiling panel supporting stringer, said end edge of said folded portion abuts against the other side of said main plate portion of said first ceiling panel supporting stringer beside said insertion hole to prevent said connecting projection from being withdrawn from said insertion hole.

5. The connecting mechanism for ceiling panel supporting stringers as claimed in claim 1, further comprising a restricting projection which is formed on said main plate portion of said first ceiling panel supporting stringer beside said insertion hole and with which said end edge of said backward projection is elastically engageable.

6. The connecting mechanism for ceiling panel supporting stringers as claimed in claim 5, wherein said backward projection is provided with a reinforcing rib protruding in the thickness direction thereof.

7. The connecting mechanism for ceiling panel supporting stringers as claimed in claim 5, wherein said backward projection of said connecting projection comprises a folded portion formed by folding back said connecting projection at about 180 degrees and having an end edge, said folded portion being shaped such that its vertical length is generally the same as that of said insertion hole and the distance from said end edge to said forward end of said base plate portion is generally the same as the thickness of said main plate portion of said ceiling panel supporting stringer, whereby, when said connecting projection of said second ceiling panel supporting stringer is pressingly inserted through said insertion hole of said first ceiling panel supporting stringer, said end edge of said folded portion abuts against the other side of said main plate portion of said first ceiling panel supporting stringer beside said insertion hole to prevent said connecting projection from being withdrawn from said insertion hole.

8. The connecting mechanism for ceiling panel supporting stringers as claimed in claim 1, wherein said backward projection is provided with a reinforcing rib protruding in the thickness direction thereof.

9. The connecting mechanism for ceiling panel supporting stringers as claimed in claim 8, wherein said backward projection is provided with a reinforcing ribs protruding from both said thereof.

10. The connecting mechanism for ceiling panel supporting stringers as claimed in claim 1, wherein said base plate portion and said connecting projection are integrally formed with said main plate portion of said ceiling panel supporting stringer.

11. The connecting mechanism for ceiling panel supporting stringers as claimed in claim 1, wherein a connecting plate comprising said base plate portion and said connecting projection is joined to one side of said main plate portion of said ceiling panel supporting stringer.

12. The connecting mechanism for ceiling panel supporting stringers as claimed in claim 1, wherein said backward projection of said connecting projection comprises a folded portion formed by folding back said connecting projection at about 180 degrees and having an end edge, said folded portion being shaped such that its vertical length is generally the same as that of said insertion hole and the distance from said end edge to said forward end of said base plate portion is generally the same as the thickness of said main plate portion of said ceiling panel supporting stringer, whereby, when said connecting projection of said second ceiling panel supporting stringer is pressingly inserted through said insertion hole of said first ceiling panel supporting stringer, said end edge of said folded portion abuts against the other side of said main plate portion of said first ceiling panel supporting stringer beside said insertion hole to prevent said connecting projection from being withdrawn from said insertion hole.

13. A connecting mechanism for connecting first and second ceiling panel supporting stringers in a T configuration, each of said ceiling panel supporting stringers comprising a main plate portion having a lower end and engaging edges extending from said lower end of said plate portion for supporting edges of ceiling panels, said connecting mechanism comprising:

an insertion hole formed through said main plate portion of said first ceiling panel supporting stringer;

a base plate portion extending from an end of said second ceiling panel supporting stringer and having a forward end;

a connecting projection extending in the same direction as the extending direction of said base plate portion from said forward end of said base plate portion and having a vertical length which is generally the same as that of said insertion hole;

a backward projection extending at an angle of about 180 degrees from said connecting projection and having an end edge, said backward projection being shaped such that the distance from said end edge to said forward end of said base plate portion is generally the same as the thickness of said main plate portion of said ceiling panel supporting stringer; and a restricting notch formed in a side edge of said insertion hole and a restricting lug engageable with said restricting notch and projecting from said end edge of said backward projection, wherein said backward projection of said connecting projection comprises a U-shaped raised portion raised in the thickness direction of said connecting projection and having a forward edge continuous with said connecting projection and the free backward edge, said U-shaped raised portion being shaped such that the distance from said free backward edge to said forward end of said base plate portion is generally the same as the thickness of said main plate portion of said ceiling panel supporting stringer, whereby, when said connecting projection of said second ceiling panel supporting stringer is pressingly inserted through said insertion hole of said first ceiling panel supporting stringer, said free end edge of said U-shaped raised portion abuts against the other side of said main plate portion of said first ceiling panel supporting stringer beside said insertion hole to prevent said connecting projection from being withdrawn from said insertion hole.

14. A connecting mechanism for connecting first and second ceiling panel supporting stringers in a T configuration, each of said ceiling panel supporting stringers comprising a main plate portion having a lower end and engaging edges extending from said lower end of said plate portion for supporting edges of ceiling panels, said connecting mechanism comprising:

an insertion hole formed through said main plate portion of said first ceiling panel supporting stringer;

a base plate portion extending from an end of said second ceiling panel supporting stringer and having a forward end;

a connecting projection extending in the same direction as the extending direction of said base plate portion from said forward end of said base plate portion and having a vertical length which is generally the same as that of said insertion hole;

a backward projection extending at an angle of about 180 degrees from said connecting projection and having an end edge, said backward projection being shaped such that the distance from said end edge to said forward end of said base plate portion is generally the same as the thickness of said main plate portion of said ceiling panel supporting stringer; and a restricting projection which is formed on said main plate portion of said first ceiling panel supporting stringer beside said insertion hole and with which said end edge of said backward projection is elastically engageable, wherein said backward projection of said connecting projection comprises a U-shaped raised portion raised in the thickness direction of said connecting projection and having a forward edge continuous with said connecting projection and the free backward edge, said U-shaped raised portion being shaped such that the distance from said free backward edge to said forward end of said base plate portion is generally the same as the thickness of said main plate portion of said ceiling panel supporting stringer, whereby, when said connecting projection of said second ceiling panel supporting stringer is pressingly inserted through said insertion hole of said first ceiling panel supporting stringer, said free edge of said U-shaped raised portion abuts against the other side of said main plate portion of said first ceiling panel supporting stringer beside said insertion hole to prevent said connecting projection from being withdrawn from said insertion hole.

* * * * *